United States Patent [19]

Acton et al.

[11] 4,225,310

[45] Sep. 30, 1980

[54] RESIN FINISHING OF TEXTILES CONTAINING CELLULOSIC FIBERS

[75] Inventors: Brian Acton, Aesch; Bruno Kissling, Riehen; Tibor Robinson, Birsfelden; Milica Urosevic, Basel, all of Switzerland

[73] Assignee: Sandoz Ltd., Basel, Switzerland

[21] Appl. No.: 920,495

[22] Filed: Jun. 29, 1978

[30] Foreign Application Priority Data

Jul. 5, 1977 [CH] Switzerland ..... 8240/77

[51] Int. Cl.[2] ..... D06P 3/82

[52] U.S. Cl. ..... 8/491; 252/8.8; 427/151; 8/602; 8/529; 8/532

[58] Field of Search ..... 8/21 C, 54.2, 2.5 A, 8/85 R, 85 B, 92, 93; 427/151

[56] References Cited

U.S. PATENT DOCUMENTS

| | | | |
|---|---|---|---|
| 2,786,081 | 3/1957 | Kress | 260/615 |
| 3,466,278 | 9/1969 | Hochreuter et al. | 260/249.6 |
| 4,072,462 | 2/1978 | Vellins et al. | 8/2.5 A |

FOREIGN PATENT DOCUMENTS

| | | |
|---|---|---|
| 837650 | 7/1976 | Belgium . |
| 2221411 | 7/1971 | Fed. Rep. of Germany . |
| 776468 | 6/1957 | United Kingdom . |
| 1445201 | 8/1976 | United Kingdom . |
| 1483792 | 8/1977 | United Kingdom . |
| 1489206 | 10/1977 | United Kingdom . |

*Primary Examiner*—A. Lionel Clingman

*Attorney, Agent, or Firm*—Gerald D. Sharkin; Richard E. Vila; Thomas C. Doyle

[57] ABSTRACT

The present invention provides a textile finishing process comprising applying to a substrate containing cellulose fibres an aqueous medium comprising A. a water-soluble, monomeric, resin-forming precondensate consisting of one or more N-methylol derivates of melamine, urea, substituted ureas, triazones, carbamates and urones, or mixtures thereof, said derivative containing at least 3 N-methylol groups or their lower alkyl ethers, B. one or more compounds having solvent properties for disperse dyes, which also increase their substantivity to cellulose, and at the same time have affinity for polyester fibres.

C. One or more reactive softeners which are capable of chemical reaction with the —OH groups of cellulose, thereby reducing their hydrophilic properties, and D. a catalyst system for the simultaneous cross-linking of components A, B and C which causes neglible yellowing of cellulose fibres up to a temperature of 220° C., subsequently drying the substrate and subjecting it to a temperature at which cross-linking takes place.

The treated substrates have increased affinity for disperse dyes, as well as crease resistant properties.

14 Claims, No Drawings

RESIN FINISHING OF TEXTILES CONTAINING CELLULOSIC FIBERS

This invention relates to a treatment process for textile substrates comprising cellulose fibres alone or in admixture with synthetic fibres, particularly polyester fibres.

According to the present invention there is provided a textile finishing process comprising applying to a substrate containing cellulose fibres an aqueous medium comprising A. a water-soluble, monomeric, resin-forming precondensate consisting of one or more N-methylol derivates of melamine, urea, substituted ureas, triazones, carbamates and urones, or mixtures thereof, said derivative containing at least 3 N-methylol groups of their lower alkyl ethers, B. one or more compounds having solvent properties for disperse dyes, which also increase their substantivity to cellulose, and at the same time have affinity for polyester fibres.

C. one or more reactive softeners which are capable of chemical reaction with the -OH groups of cellulose, thereby reducing their hydrophilic properties, and D. a catalyst system for the simultaneous cross-linking of components A, B and C which causes negligible yellowing of cellulose fibres up to a temperature of 220° C., subsequently drying the substrate and subjecting it to a temperature at which cross-linking takes place.

The cellulose fibre-containing substrate is suitably impregnated with the aqueous medium comprising components A-D, e.g. using padding techniques. The pick up is generally of the order of from 60 to 120%, preferably from 70 to 100% and most preferably from 85 to 90%, depending, of course, on the method of application, the nature of the substrate and the concentration of the cross-linking agents in the medium. After application of medium, usually effected at room temperature, the substrate is dried, suitably at 70°-120° C., and cured, i.e. cross-linking is allowed to take place.

The substrates treated in this way display increased affinity for disperse dyes, and may be dyed (e.g. by the block process) or printed either directly or by means of a dye carrier (transfer printing) so as to give wash-fast dyeings or printings. Suitable disperse dyes include C.I. Yellow 54, C.I. Yellow 50, C.I. Orange 20, C.I. Orange 21, C.I. Red 74, C.I. Red 72, C.I. Red 121, C.I. Red 60, C.I. Red 167, C.I. Blue 73, C.I. Blue 1 and C.I. Blue 2.

Dyeing and printing processes using disperse dyes normally include a heat-fixation step, and the finish applied to the substrate by impregnation with A-D followed by drying may be cured simultaneously with the heat-fixation of the dyestuff. Such heat-fixing may, for example, in a continuous dyeing process be carried out at temperatures up to 220° C. (Thermosol process), or, in a direct printing process, advantageously by steam at 160°-180° C. for 5 to 8 minutes (HD process). Transfer printing may be carried out in known manner employing temperatures of 180°-220° C. for 30-60 seconds.

Alternatively, the curing of the finish may be carried out by a separate heat-fixation step before the dyeing or printing operation. When this is the case, curing may be carried out under conditions which are conventional in the resin-treatment of cellulose fabrics, i.e. at temperatures up to 220° C., preferably 100°-180° C., more preferably 130°-180° C. The time required will depend upon the temperature, the nature of the substrate, and the activity of the catalyst system employed.

By the process of the invention, not only are good dyeings obtained, but the substrate is given a wash-fast crease-resistant finish and improved dimensional stability.

Component A is preferably a compound of formula I

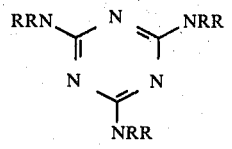

I in which each R independently is H or $—CH_2OR_1$, where each $R_1$ independently is H or $C_{1-4}$alkyl, provided that at least 3 R groups, preferably at least 4 and most preferably all 6 R groups are $—CH_2OR_1$ groups. Preferably 50-100%, more preferably 80-100% of all $R_1$ groups present are $C_{1-4}$alkyl, preferably methyl.

Component B is preferably a compound or mixture of compounds from one or more of the following groups (i)-(iv):

(i) a polymeric condensation product of a polyalkylene glycol with an aldehyde, particularly formaldehyde. Suitable products of this type are described in British patent 776 468 and U.S. Pat. No. 2,786,081. Preferred is a reactive acetal of formula II

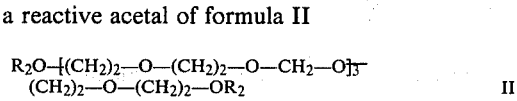

II in which each $R_2$ is independently H or $CH_2OH$.

(ii) a carboxylic acid amide of formula III

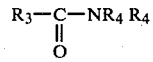

III in which $R_3$ is H, $C_{1-8}$alkyl, or phenyl unsubstituted or substituted with up to 5 $C_{1-2}$alkyl groups, and each $R_4$ independently is hydrogen or a polyglycol residue, the terminal hydroxyl group of which may be esterified by a $C_{1-4}$ fatty acid, provided that no more than one $R_4$ group may be hydrogen.

Preferred compounds of formula III are compounds of formula IIIa

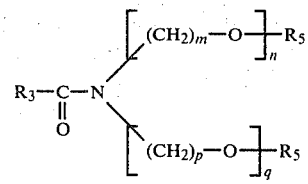

IIIa in which $R_3$ is as defined above, m and p are independently 2, 3 or 4 and the sum of n and q lies between 2 and 30 so that the average molecular weight of the compound of formula IIIa is not greater than 2000, and each $R_5$, independently, is hydrogen, formyl or acetyl.

More preferred compounds of formula IIIa are compounds of formula IIIb

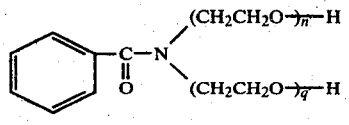

IIIb in which the sum of n' and q' lies between 6 and 25; and compounds of formula IIIc

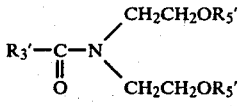

IIIc in which $R_3'$ is $C_{1-4}$alkyl, preferably methyl, and each $R_5'$ independently is a formyl or acetyl group, particularly the compound of formula IV

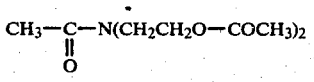

IV (iii) a carboxylic acid diamide of formula V

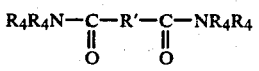

V in which R' is $C_{1-8}$alkylene, or phenylene unsubstituted or substituted with up to 4 $C_{1-2}$alkyl groups, and $R_4$ is as defined above, provided that not more than one $R_4$ group on each nitrogen atom may be hydrogen.

Preferred compounds of formula V are those of formula Va

Va

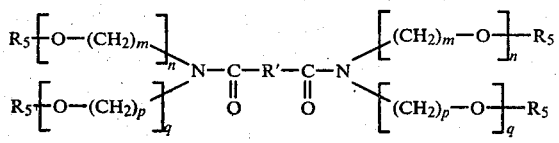

in which R', m, n, p, q and $R_5$ are as defined above, the average molecular weight of the compound of formula Va being no greater than 2000.

More preferred compounds of formula Va are those in which R' is $C_{1-4}$alkylene and $R_5$ is formyl or acetyl, particularly the compound

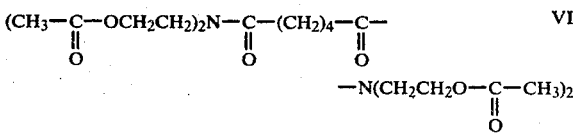

VI (iv) A low molecular weight polyamide of formula VII

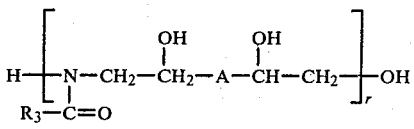

VII in which $R_3$ is as defined above, and A signifies a direct C—C bond or an alkylene group of 2–4 carbon atoms which may be interrupted by $C_{2-3}$ alkyleneoxy groups, and r is a whole number greater than 15, provided that the average molecular weight of the compound of formula VII is not greater than 2000.

The compounds of types (i)–(iv) above have the ability to react with cellulose and at the same time to accelerate the uptake of disperse dyes on polyester fibres.

Compound C is preferably an N-methylol compound containing at least one higher ($C_{11-19}$)straight-chain alkyl group. Such compounds may for example be:

(a) an optionally etherified N-methylol substituted higher fatty acid amide of formula VIII $R_6$·CO·NHC-$H_2$ØR1 where $R_6$ is a straight chain ($C_{11-19}$)alkyl group and $R_1$ is as defined above.

N-methylol stearic acid amide, optionally etherified with methanol is a preferred compound of this class.

(b) an optionally etherified N-methylol derivative of a urea or melamine substituted by at least one ($C_{12-20}$) acyl group, particularly compounds of formula IX

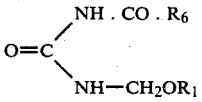

IX where $R_1$ and $R_6$ are as defined above.

Preferably $R_6$ is $CH_3(CH_2)_{16}$-or .

(c) a quaternised melamine derivative containing at least one $C_{12-30}$)alkoxy group, resulting from the reaction of 1 mol of hexamethylolmelamine at least 80% by weight of which is etherified with a low molecular weight alcohol with (a) one or more organic monocarboxylic acids with 1 to 30 carbon atoms, (b) 0.5 to 1.2 mols of a tertiary amine containing at least one hydroxy alkyl radical with 2 to 4 carbon atoms, and (c) 1 to 2.2 mols of a fatty alcohol with 12 to 30 carbon atoms or mixture of such fatty alcohols, with the proviso that at least 80% of (b) must be present in the form of a salt with (a) and that the total quantity of (a) used amounts to 0.4 to 2.5 mols, the portion of any monocarboxylic acid or acids with 12 to 30 carbon atoms present being chosen in such a way that the sum of the latter and (c) amounts to at least 1 mol and at most 2.5 mols, and quaternizing thereafter, as described in U.S. Pat. No. 3,466,278, the contents of which are incorporated herein by reference. A preferred compound is that of Example 7 of the above U.S. patent, i.e. the product obtained by reacting 1 mol of hexamethylolmelamine hexamethyl ether with 2 mols of stearyl alcohol and the reaction product of 1 mol of triethanolamine and 1.2 mols of acetic acid and quaternizing 0.1 mol of the resulting product with 0.08 mol of dimethyl sulphate.

Mixtures of compounds of types (a), (b), and (c) may also be used.

Component D is preferably a catalyst system comprising the following three or four components:

(i) a hydrolysis-stable resin-forming N-methylol compound (ii) a catalyst comprising an acid reacting salt of a multivalent metal (iii) an alkali metal sulphate or borate and (iv) optionally, phosphoric acid and/or an organic acid containing at least two carboxylic acid groups. Although component (i) of D is itself a resin-forming compound, the catalyst present in D can also effect curing of components A, B and C, these components cross-linking with each other and with D(i) and with the hydroxyl groups on cellulose.

The hydrolysis stable N-methylol compounds employed as component (i) are suitably those described in Textil-Veredlung 3, No. 8, 414–415 (1968), and have not more than two N-methylol groups in the molecule. Preferred compounds for use as component (i) are the N,N'-dimethylol and N,N'-dialkoxy-methyl derivatives of 4,5-dihydroxy or 4,5-dimethoxy-ethylene urea.

Examples of acid reacting salts, i.e. salts which when dissolved in water give a solution of pH lower than 7, are the nitrates, chlorides, sulphates, acetates, formates, fluoroborates and hydrogen phosphates of aluminium, zinc and magnesium. For use as component (ii) of D these may be used singly or as mixtures; aluminium salts, particularly aluminium chloride, being preferred. Magnesium salts have low activity and their use in the absence of salts of other metals is not preferred. However, a mixture of aluminium and magnesium salts, particularly aluminium nitrate and magnesium chloride, is advantageous. Catalyst systems of this type are described in Swiss Pat. No. 538 005.

A further preferred mixture of acid-reacting salts is a mixture consisting of an aluminium salt containing no nitrate or chloride ions, for example aluminium sulphate, formate or acetate, together with a zinc salt containing no nitrate or chloride ions, for example zinc sulphate or fluoroborate. A particularly preferred mixture of this type is one of aluminium sulphate and zinc fluoroborate.

Component (iii) is preferably sodium or potassium sulphate, or a mixture of these.

Components (i), (ii) and (iii) are preferably present in weight ratios of 25–200:2–30:1–40, more preferably 10–30:1–4:2–4.

Component (iv) may be omitted except when component (ii) consists of a mixture of aluminium and zinc salts containing no nitrate or chloride ions, as described above, in which case component (iv), which is preferably phosphoric acid, is suitably present in essentially the same range of weight ratios as is component (iii).

Component D may suitably be used in the form of an aqueous concentrate, for example one containing 50 parts by weight (i), 12.5 parts by weight (ii), 10 parts by weight (iii) and 50 parts by weight water.

By choosing suitable concentrations of components A-D, the aqueous medium employed in the process of the invention may be a true solution, which is preferred.

The concentration of component A is preferably 50–150 g/l, more preferably 80–100 g/l where the substrate is 100% cellulose fibres. For mixtures of cellulose and polyester, the concentration is preferably 20–120 g/l, more preferably 50–80 g/l, depending upon the cellulose content of the substrate.

The concentration of component B is suitably from 25 to 200 g/l, preferably from 50 to 100 g/l, depending upon the depth of dyeing and the composition of the substrate.

The concentration of component C is preferably from 25–200 g/l, more preferably from 50–100 g/l.

The preferred concentration of catalyst system D is that necessary to produce cross-linking of the components A, B and C in the amount in which they are present; normally this will be from 7.5 to 15% by weight of the total quantity of A+B+C present in the aqueous medium. When component D is used in the form of a concentrate as described above, suitable weight ratios for components A-D are as follows:

A:B:C:D (concentrate)=1–2:0.5–1.5:0.5–1.5:0.5–1.5, more preferably 1–2:1:1:1

The aqueous media employed in the process of the invention form a further feature of the invention. Such aqueous media may be made up by dilution of aqueous concentrates, or by addition of the components to water, either individually or in the form of mixtures of two or more of the components. A preferred system comprises addition of components A and B in the form of a mixture, components C and D being added separately.

Such mixtures of components A and B form a further aspect of the invention. The components A and B are suitably present in such mixtures in weight ratio of from 1:4 to 4:1, preferably 1:1.

Aqueous concentrates or mixtures containing component D together with one or more of components A, B and C are unstable to storage and are therefore not preferred.

The following Examples, in which all parts and percentages are by weight and all temperatures are in degrees Centigrade, illustrate the invention.

EXAMPLE 1

A mixed textile fabric consisting of 50% cotton and 50% polyester fibres (trade name "Dacron") is impregnated with an aqueous solution containing (A) 80 g/l of methoxy-hexamethylolmelamine (commercial grade, 80% etherified)

(b) 50 g/l of a compound of formula IV

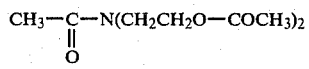

$$CH_3-\underset{\underset{O}{\|}}{C}-N(CH_2CH_2O-COCH_3)_2 \qquad \text{IV}$$

(C) 50 g/l commercial methylolated stearic acid amide (D) 50 g/l of a catalyst system concentrate consisting of (a) 50 parts dimethyloldihydroxyethyleneurea (100%)

(b) 5 parts crystalline aluminium nitrate (c) 7.5 parts crystalline magnesium chloride (d) 10 parts sodium sulphate and (e) 50 parts water, and then is squeezed to 70% residual moisture and predried at 120° C.

The treated fabric is then printed with a printing paste consisting of

3% C.I. Disperse Yellow 54

37% water, and

60% of a commercial emulsion of a sodium alginate thickener, consisting of

59% sodium alginate,

35% white spirit
5% water, and
1% anionically modified alkylpolyglycol ether.

After printing the dyestuff is fixed with superheated steam at 160° for 7 minutes and the fabric is then washed in the normal way.

A tone-in-tone colouring on both fibres with very good wash- and light-fastness is obtained. The fabric has a good permanent crease-resistance.

EXAMPLE 2

A 100% cotton textile fabric is treated with a solution consisting of (A) 100 g/l of component (A) of Example 1
(b) 50 g/l of component (B) of Example 1
(C) 25 g/l of the product of Example 7 of U.S. Pat. No. 3,466,278
(D) 50 g/l of the catalyst concentrate of Example 1.

The fabric is padded with the above solution, squeezed to approx. 80% residual moisture and dried at 120°–130° to a residual moisture of approx. 8–9%.

The treated fabric is printed with a printing paste as in Example 1, but with C.I. Disperse Blue 1 replacing the Disperse Yellow. The dyestuff is fixed with superheated steam at 165° for 7 minutes and the fabric washed in the normal way. A deep, brilliant, blue shade is obtained, having good wash- and light-fastness. The fabric is characterised by good crease resistance and dimensional stability.

EXAMPLE 3

A mixed fabric consisting of 67% polyester, 33% cotton is padded to give a 70% pickup of an aqueous solution containing (A) 50 g/l of component (A) of Example 1
(B) 50 g/l of a mixture of reactive polyglycol acetals of formula II above (commercial product containing 100% active substance)
(C) 50 g/l of component C of Example 2
(D) 30 g/l of the catalyst concentrate of Example 1, and dried at 120°–130° C.

The treated fabric is printed with a printing paste as in Example 1, but with C.I. Disperse Red 74 replacing the Disperse Yellow. Fixing is carried out with superheated steam at 165° for 7 minutes, followed by normal washing. A wash-resistant brilliant scarlet tone with good light fastness is obtained, the fabric having good crease-resistant properties.

EXAMPLE 4

A mixed fabric consisting of 67% polyester, 33% cotton is treated with the aqueous medium according to Example 1, and dried at 120°. The treated fabric is dyed by transfer printing, using a transfer-printing paper coated with a base thickener consisting of 1% conventional emulsifier (anionic-modified alkylpolyglycol ether)
49% water
40% 8% starch ether thickener and
10% white spirit and a printing paste containing 6% C.I. Disperse Red 60. Transfer printing is carried out in a Bemrose transfer press at 215° C. for 30 seconds.

The printed fabric has a deep, brilliant red tone with good wash- and light-fastness. Good crease-resistance is also obtained.

EXAMPLE 5

A mixed fabric of 50/50 polyester/cotton is treated with the aqueous medium of Example 2 and dried at 120°. Transfer printing is carried out as in Example 4, using 6% C.I. Disperse Yellow 8 as dyestuff, at 215° for 30 seconds. A deep, brilliant yellow dyed fabric with good wash and light fastness as well as crease resistance, is obtained.

By heating at 160° for 5 minutes instead of at 120°, drying and curing of the finish occurs simultaneously. The fabric bearing the cured finish is transfer printed as described above, and the same results are obtained.

What is claimed is:

1. A textile finishing process which comprises applying to a substrate containing cellulosic fibers an amount effective to improve the crease resistance and dimensional stability of said substrate of an aqueous medium comprising (A) a water soluble, monomeric, resin-forming precondensate of the formula

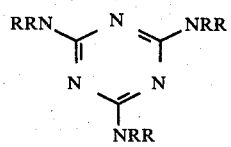

in which each R independently is H or $—CH_2OR_1$, where each $R_1$ independently is H or $C_{1-4}$alkyl, provided that at least 3 R groups are $—CH_2OR_1$ groups, (B) a compound or mixture of compounds which have solvent properties for disperse dyes and affinity for polyester fibres and which increase the substantivity of disperse dyes to cellulose and selected from the group consisting of (i) a polymeric condensation product of a polyalkylene glycol with an aldehyde,
(ii) a carboxylic acid amide of formula III $$R_3—\underset{\underset{O}{\|}}{C}—NR_4R_4 \qquad \text{III}$$

in which $R_3$ is H, $C_{1-8}$alkyl, or phenyl unsubstituted or substituted with up to 5 $C_{1-2}$alkyl groups, and each $R_4$ independently is hydrogen or a polyglycol residue, the terminal hydroxyl group of which may be esterified by a $C_{1-4}$ fatty acid, provided that no more than one $R_4$ group may be hydrogen, (iii) a carboxylic acid diamide of formula V $$R_4R_4N—\underset{\underset{O}{\|}}{C}—R'—\underset{\underset{O}{\|}}{C}—NR_4R_4 \qquad \text{V}$$

in which R′ is $C_{1-8}$alkylene, or phenylene unsubstituted or substituted with up to 4 $C_{1-2}$alkyl groups, and $R_4$ is as defined above, provided that not more than one $R_4$ group on each nitrogen atom may be hydrogen, and (iv) a low molecular weight polyamide of formula VII

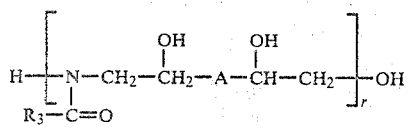

VII in which $R_3$ is as defined above, and A signifies a direct C-C bond or an alkylene group of 2-4 carbon atoms which may be interrupted by $C_{2-3}$ alkyleneoxy groups, and r is a whole number greater than 15, provided that the average molecular weight of the compound of formula VII is not greater than 2000, (C) an N-methylol compound which contains at least one ($C_{11-19}$) straight-chain alkyl group and is capable of chemical reaction with the —OH groups of cellulose, and (D) a catalyst system comprising the following three or four components:

(i) a hydrolysis-stable resin-forming N-methylol compound, (ii) a catalyst comprising an acid reacting salt of a multivalent metal (iii) an alkali metal sulphate or borate, and (iv) optionally, phosphoric acid or an organic acid containing at least two carboxylic acid groups.

2. A process according to claim 1 wherein:

component (A) is a compound of formula I in which at least four of the R's are $—CH_2OR_1$ and 50 to 100% of thegroups $R_1$ are $C_{1-4}$alkyl;

component (B) is a compound or mixture of compounds from one or more of the groups (i)-(iv):

(i)

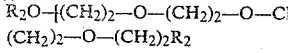

wherein each $R_2$ is independently hydrogen or $—CH_2OH$;

(ii) a carboxylic acid amide of formula

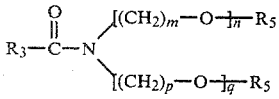

in which m and p are independently 2, 3 or 4 the sum of n and q is between 2 and 30 such that the average molecular weight of the compound is not greater than 2000 and each $R_5$ is, independently, hydrogen, formyl or acetyl;

(iii) a carboxylic acid diamide having a molecular weight no greater than 2000 and being of the formula

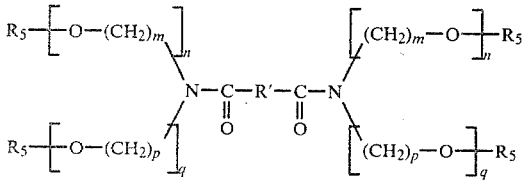

in which m, n, p, q and $R_5$ are as defined above;

(iv) a compound of formula VII as defined in claim 13; component (C) is (i) a compound of the formula

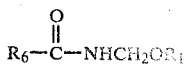

wherein $R_6$ is a straight chain ($C_{11-19}$)alkyl or (ii) an optionally etherified N-methylol derivative of a urea or melamine substituted by at least one ($C_{12-20}$) acyl group, or (iii) a quaternized melamine derivative obtained by reaction of 1 mol of hexamethylolmelamine at least 80% by weight of which is etherified with a low molecular weight alcohol with (a) one or more organic monocarboxylic acids with 1 to 30 carbon atoms, (b) 0.5 to 1.2 mols of a tertiary amine containing at least one hydroxy alkyl radical with 2 to 4 carbon atoms, and (c) 1 to 2.2 mols of a fatty alcohol with 12 to 30 carbon atoms or mixture of such fatty alcohols, with the proviso that at least 80% of (b) must be present in the form of a salt with (a) and that the total quantity of (a) used amounts to 0.4 to 2.5 mols, the portion of any monocarboxylic acid or acids with 12 to 30 carbon atoms present being chosen in such a way that the sum of the latter and (c) amounts to at least 1 mol and at most 2.5 mols, and quaternizing thereafter, and component (D) is a catalyst system as defined in claim 13 wherein component (i) is an N,N'-dimethylol or N,N'-dialkoxy-methyl derivative of 4,5-dihydroxy or 4,5-dimethoxyethylene urea.

3. A process according to claim 2 wherein component (ii) of catalyst system (D) is selected from the nitrates, chlorides, sulphates, acetates, formates, fluoroborates and hydrogen phosphates of aluminum, zinc and magnesium and component (iii) of said system is sodium or potassium sulphate.

4. A process according to claim 2 wherein component (B)(ii) is selected from the group consisting of compounds of formula IIIb

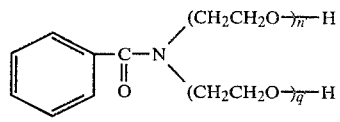

IIIb in which the sum of n' and q' lies between 6 and 25; and compounds of formula IIIc

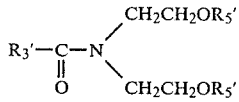

IIIc in which $R_3'$ is $C_{1-4}$alkyl and each $R_5'$ is, independently, formyl or acetyl and component (B)(iii) is the compound of the formula

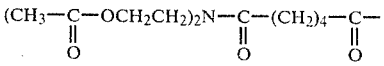

VI

-continued $$-N(CH_2CH_2O-\underset{\underset{O}{\|}}{C}-CH_3)_2$$

5. A process according to claim 2 wherein component (C)(iii) is the reaction product of 0.08 mol of dimethyl sulphate with 0.1 mol of the product produced by reacting 1 mol of hexamethylolmelamine hexamethyl ether with 2 mols of stearyl alcohol and the reaction product of 1 mol of triethanolamine and 1.2 mols of acetic acid.

6. A process according to claim 1 wherein components (i), (ii) and (iii) of catalyst system (D) are present in weight ratios of 25-200:2-30:1-40.

7. A process according to claim 1 wherein the substrate is impregnated with the aqueous medium comprising components (A), (B), (C) and (D) to pick-up of 60-120%.

8. A process according to claim 1 in which the aqueous medium contains 20-150 g/l of component A, 25-200 g/l of component B, 25-200 g/l of component C and from 7.5 to 15% by weight of the total quantity of A+B+C of component D.

9. A process according to claim 8 in which the weight ratios of components A-D (in the form of an aqueous concentrate containing equal weights of component (i) and of water) is 1-2:0.5-1.5:0.5-1.5:0.5-1.5.

10. A process according to claim 1 in which the treated and dried substrate is dyed or printed with a disperse dye and simultaneously or subsequently subjected to a temperature at which cross-linking of components A-D and heat-fixation of the dyestuff occur at the same time.

11. A process according to claim 1 in which the treated substrate is subjected to a temperature at which drying and cross-linking of components A-D occurs, and the fully cross-linked treated substrate is then transfer printed.

12. A process according to claim 1 in which the substrate contains both cellulose and polyester fibres.

13. An undyed textile substrate containing cellulose fibres which is the product of the process of claim 1.

14. A dyed or printed textile substrate containing cellulose fibres which is the product of the process of claim 10.

* * * * *

UNITED STATES PATENT AND TRADEMARK OFFICE

CERTIFICATE OF CORRECTION

PATENT NO. : 4,225,310

DATED : September 30, 1980

INVENTOR(S) : Brian Acton/Bruno Kissling/Tibor Robinson/Milica Urosevic

It is certified that error appears in the above—identified patent and that said Letters Patent is hereby corrected as shown below:

Column 9, Claim 2, line 33; delete "thegroups" and insert in its place --the groups--.

Column 9, Claim 2, line 38; delete the group "$(CH_2)_2$-O-$(CH_2)_2R_2$" and insert in its place the group --$(CH_2)_2$-O-$(CH_2)_2OR_2$--.

Signed and Sealed this

Thirteenth Day of July 1982

[SEAL]

Attest:

GERALD J. MOSSINGHOFF

Attesting Officer

Commissioner of Patents and Trademarks